United States Patent [19]

Green

[11] Patent Number: 5,029,831

[45] Date of Patent: Jul. 9, 1991

[54] STAPLER INDEXING APPARATUS

[75] Inventor: Frederick A. Green, Fairport, N.Y.

[73] Assignee: Xerox Corporation, Stamford, Conn.

[21] Appl. No.: 436,512

[22] Filed: Nov. 14, 1989

[51] Int. Cl.[5] ..... B65H 39/00

[52] U.S. Cl. ..... 270/53; 227/111; 227/101

[58] Field of Search ..... 270/37, 53, 58; 227/110, 111, 120, 107, 101

[56] References Cited

U.S. PATENT DOCUMENTS

| | | | |
|---|---|---|---|
| 3,016,538 | 1/1962 | Oussani | 227/110 |
| 4,134,672 | 1/1979 | Burlew et al. | 355/14 |
| 4,281,920 | 8/1981 | Cross | 355/75 |
| 4,293,214 | 10/1981 | George et al. | 355/14 R |
| 4,313,670 | 2/1982 | Caldwell | 355/3 R |
| 4,358,197 | 11/1982 | Kukucka et al. | 355/14 R |
| 4,382,592 | 5/1983 | Harding | 270/53 |
| 4,552,497 | 11/1985 | Kockler | 270/37 |
| 4,564,185 | 1/1986 | Hamlin et al. | 270/53 |
| 4,687,191 | 8/1987 | Stemmle | 270/53 |

*Primary Examiner*—Edward K. Look
*Assistant Examiner*—Therese M. Newholm
*Attorney, Agent, or Firm*—H. Fleischer; J. E. Beck; R. Zibelli

[57] ABSTRACT

An apparatus which positions a stapling device relative to a set of sheets. The stapling device is moved between a non-operative position spaced from an edge of a set of sheets to an operative position adjacent the edge of a set of sheets. Once in the operative position, the stapling device is transported in a direction substantially parallel to the edge of the set of sheets to a selected stapling position.

12 Claims, 7 Drawing Sheets

STAPLER INDEXING APPARATUS

This invention relates generally to an electrophotographic printing machine, and more particularly concerns an apparatus for positioning a stapling device relative to a set of copy sheets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing machine of the foregoing type, consideration must be given to the manner in which large volumes of copy sheets can be most effectively handled. One approach uses a recirculating document handler as an input device. A recirculating document handler removes successive original documents from a collated set of original documents and advances them on to an exposure platen for exposure. The original document is then returned to set of original documents in the recirculating document handler until the set of original documents has been completely circulated and a set of copy sheets produced. The set of original documents is then recycled for the reproduction of a second set of copy sheets. After each set of copy sheets is produced and collected at a finishing station, a stapler or stitcher is activated to attach the sheets of each set to one another. In this way, stapled sets of collated copy sheets are produced. Copy sheets may be printed as a landscape or portrait. In landscape printing, the page is printed so that when positioned for reading, the page is wider than it is long. In portrait printing, the page is printed so that when positioned for reading, the page is longer than it is wide. It is desirable that the stapling device used in the finishing station be capable of providing at least a portrait staple, i.e. a staple in the upper left hand corner of a set of copy sheets having the text or illustration set on the sheet in the portrait orientation, a landscape staple, i.e. a staple in the lower left hand corner of a set of copy sheets having the text or illustration set on the sheet in the landscape orientation, and a dual staple, i.e. a staple in the upper left hand corner and lower left hand corner of a set of copy sheets having the text or illustrations printed thereon in the portrait fashion.

Various approaches have been devised for stapling sets of copy sheets. The following disclosures appear to be relevant:

US-A-4,134,672
Patentee: Burlew et al.
Issued: January 16, 1979
US-A-4,281,920
Patentee: Cross
Issued: August 4, 1981
US-A-4,293,214
Patentee: George et al.
Issued: October 6, 1981
US-A-4,313,670
Patentee: Caldwell
Issued: February 2, 1982
US-A-4,358,197
Patentee: Kukucka et al.
Issued: November 9, 1982
US-A-4,564,185
Patentee: Hamlin et al.
Issued: January 14, 1986
US-A-4,687,191
Patentee: Stemmle
Issued: August 18, 1987

The relevant portions of the foregoing patents may be summarized as follows:

U.S. Pat. No. 4,134,672 discloses a copier finisher for producing booklets by stapling collated or uncollated sets of copies by adjusting the position of a stapler to a detent position corresponding to the selected paper size within the supply trays.

U.S. Pat. No. 4,281,920 describes a stapler for a duplicating machine which pivots into a stapling position and fastens a collated set of copy sheets by action of a motor and a gear in response to a control signal.

U.S. Pat. Nos. 4,293,214 and 4,313,670 disclose a stapling unit that moves into position along a compiled set of copy sheets in response to a programmed control signal. The stapler advances and retracts from an inoperative home position to a position adjacent to one corner of a compiled set of sheets and staples the stack of sheets.

U.S. Pat. No. 4,358,197 describes a finishing station which inserts staples at various positions along the long edge of a compiled set of copy sheets. A drive shaft, pulley and motor, together, translate a single stapler head to various positions along the edge of a copy sheet set.

U.S. Pat. No. 4,564,185 discloses a stapling mechanism having a motor that pivots a stapler from an inoperative position to a stapling position for binding sets of copy sheets.

U.S. Pat. No. 4,687,191 describes a finishing station having a stapler which reciprocates from a remote location to an inner limit operating position to bind an aligned set of copy sheets.

In accordance with one aspect of the present invention, there is provided an apparatus for positioning a stapling device relative to a set of sheets. The apparatus includes means for moving the stapling device from an operative position adjacent to an edge of the set of sheets to a non-operative position spaced from the edge of the set of sheets. Means, responsive to the moving means moving the stapling device to the operative position, transport the stapling device in a direction substantially parallel to an edge of the set of sheets to a selected stapling position.

Pursuant to another aspect of the features of the present invention, there is provided an electrophotographic printing machine of the type in which copy sheets are advanced to a stapling device to produce stapled sets of copy sheets. The improvement includes means for moving the stapling device from an operative position adjacent to an edge of the set of copy sheets to a non-operative position spaced from the edge of the set of copy sheets. Means, responsive to the moving means moving the stapling device to the operative position, transport the stapling device in a direction substantially parallel to an edge of the set of copy sheets to a selected stapling position.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
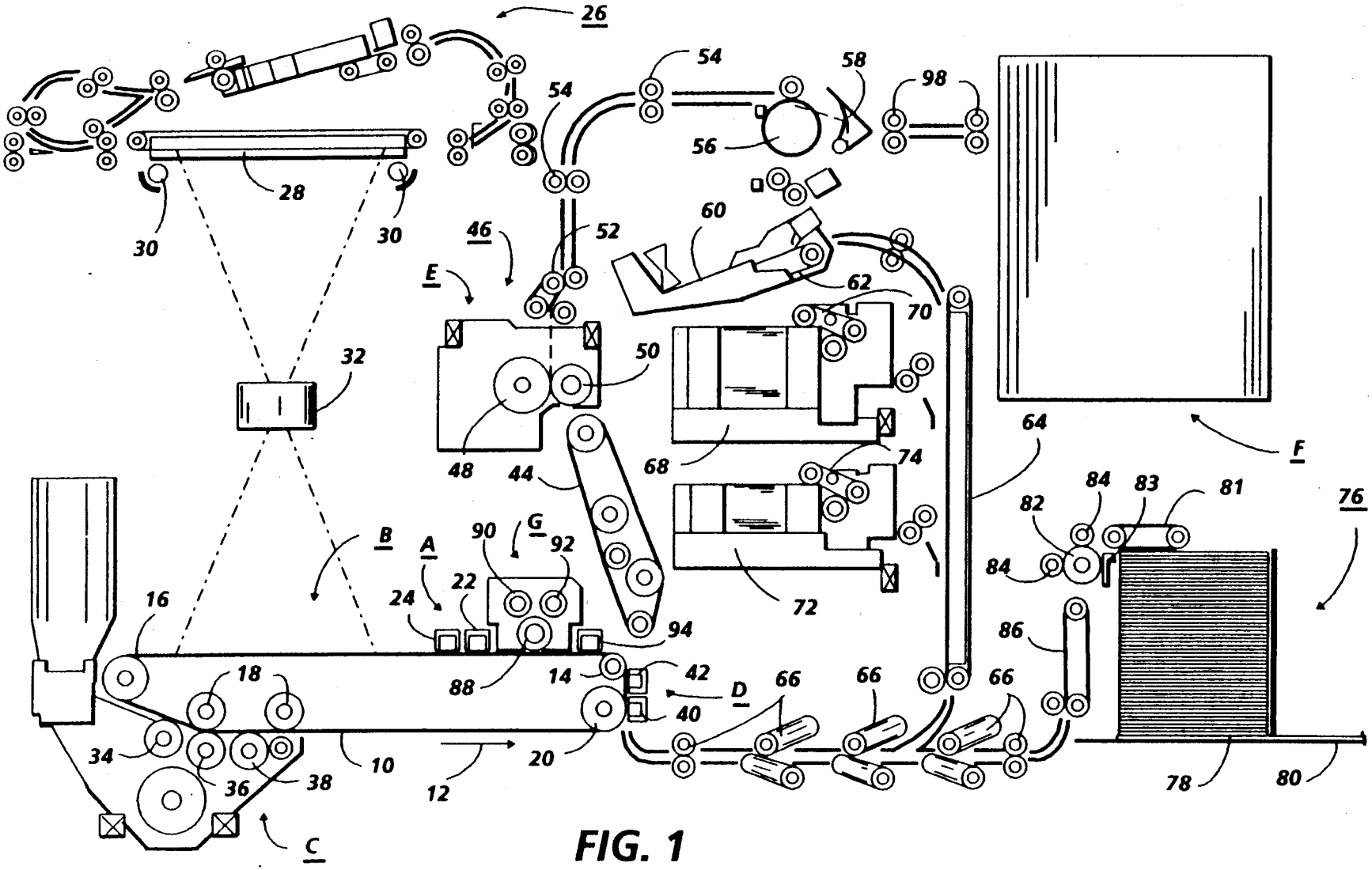
FIG. 1 is a schematic elevational view depicting an illustrative electrophotographic printing machine incorporating a finisher having the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds original documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the top of the stack of original documents through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. In this way, a plurality of original documents may be sequentially exposed. Alternatively, document handling unit 26 may be pivoted away from platen 28 and an original document positioned manually thereon. One or more copies of the original document may be reproduced by the printing machine. The original document is exposed and a latent image recorded on the photoconductive belt. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in compiler trays to form sets of copy sheets. The sheets of each set are stapled to one another. The sets of copy sheets are delivered to a stacker. In the stacker, each set of copy sheets is offset from an adjacent set of copy sheets. Further details of finishing station F will be described hereinafter with reference to FIG. 2.

With continued reference to FIG. 1, when duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scaped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
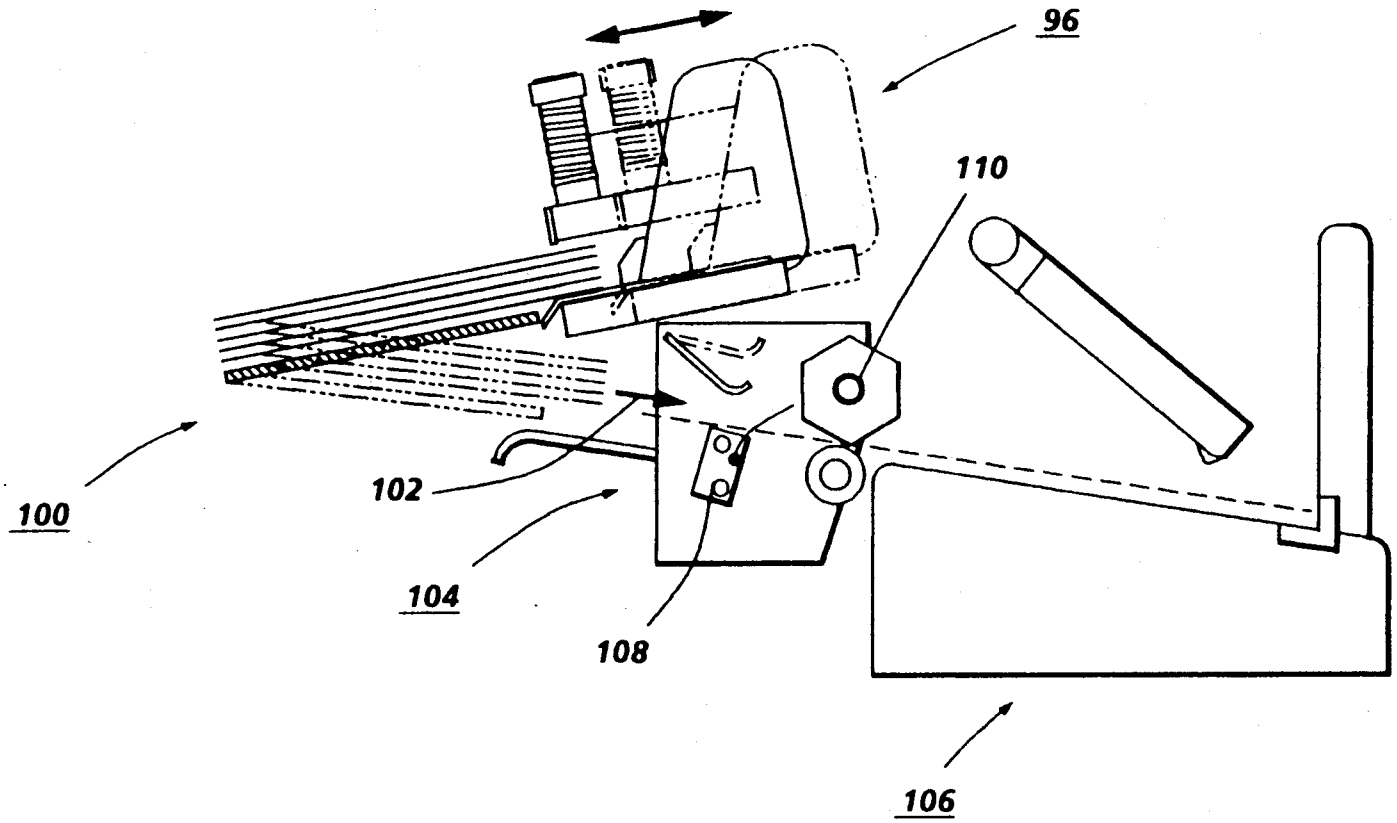
FIG. 2 is a schematic elevational view showing the finishing station of the FIG. 1 printing machine.

Referring now to FIG. 2, the general operation of finishing station F will now be described. Finishing station F receives fused copies from rolls 98 (FIG. 1) and advances them in the direction of arrow 102 to the compiler tray, indicated generally by the reference numeral 100. Compiler tray 100 has two positions, an upper position and a lower position. When the staple option is selected, the compiler tray moves to the upper position in order to compile the sets of copy sheets. After the set of copy sheets has been compiled on tray 100, a stapler, indicated generally by the reference numberal 96 moves from a non-operative position remote from the set of copy sheets to an operative position adjacent an edge of the set of copy sheets. Once the sets of copy sheets are stapled, the stapler moves from the operative position to the non-operative position and compiler tray pivots to an eject position. Stapler 96 is required to move from the operative position to the non-operative position in order to move the stapler out of the path of the compiler tray as it pivots down to the position to eject the stapled set of copy sheets. The stapled set of copy sheets is then ejected and the compiler tray raises to the upper position ready to compile the next set of copy sheets for stapling. At this time, the stapler moves from the non-operative position to the operative position. After the completed set of copy sheets is ejected from the tray, the compiler tray is ready to compile the next set of copy sheets. After stapling, the set of copy sheets is ejected into the output transport assembly, indicated generally by the reference numeral 104, which drives the set of copy sheets out of compiler tray 100 into a stacker, indicated generally by the reference numeral 106. Output switch 108 senses each set of copy sheets as it leaves compiler tray 100. Output switch 108 informs the controller if a jam occurs. If a jam does occur, the controller then declares a fault code. Sets of copy sheets can range in thickness from about two sheets to one hundred sheets. Because of the wide range of sheet sizes and the varying thicknesses of the sets of copy sheets, hexagonal shaped foam rolls 110 are used to provide a uniform nip force to drive the stacks of copy sheets to stacker 106.

Figure 3:
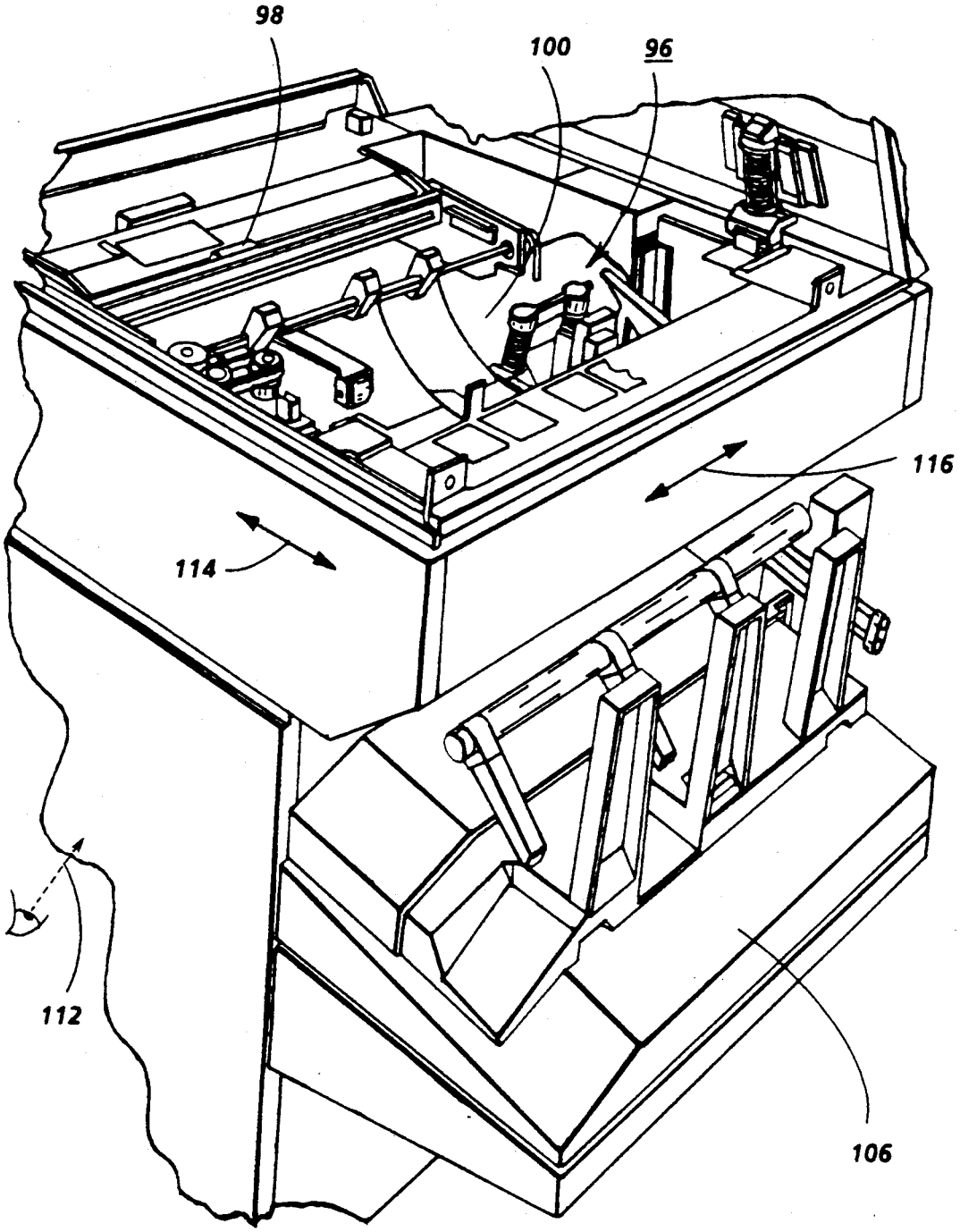
FIG. 3 is a perspective view illustrating the stapler of the FIG. 2 finishing station.

Turning now to FIG. 3, rolls 98 deliver copy sheets to compiler tray 100. Copy sheets are stacked on compiler tray 100 to form a set of copy sheets. In the operative position, stapler 96 is positioned adjacent the long edge of the set of copy sheets. Viewing the printing machine in the direction of arrow 112, stapler 96 moves between the operative position, adjacent the long edge of the set of copy sheets, and the non-operative position, remote from the set of copy sheets, in the direction of arrows 114, i.e. from left to right. When in the operative position, stapler 96 moves along the long edge of the set of copy sheets, as indicated by arrows 116, to a selected position, i.e. from front to rear. At the selected position, stapler 96 is energized to drive a staple through the set of copy sheets and to clinch the legs thereof against the bottom sheet of the set of copy sheets. After the set of copy sheets have been stapled, stapler 96 moves in the direction of arrow 114 to the non-operative position so as to be spaced from the path of compiler tray 100 as it pivots downwardly to eject the set of stapled copy sheets to stacker 106.

Figure 4:
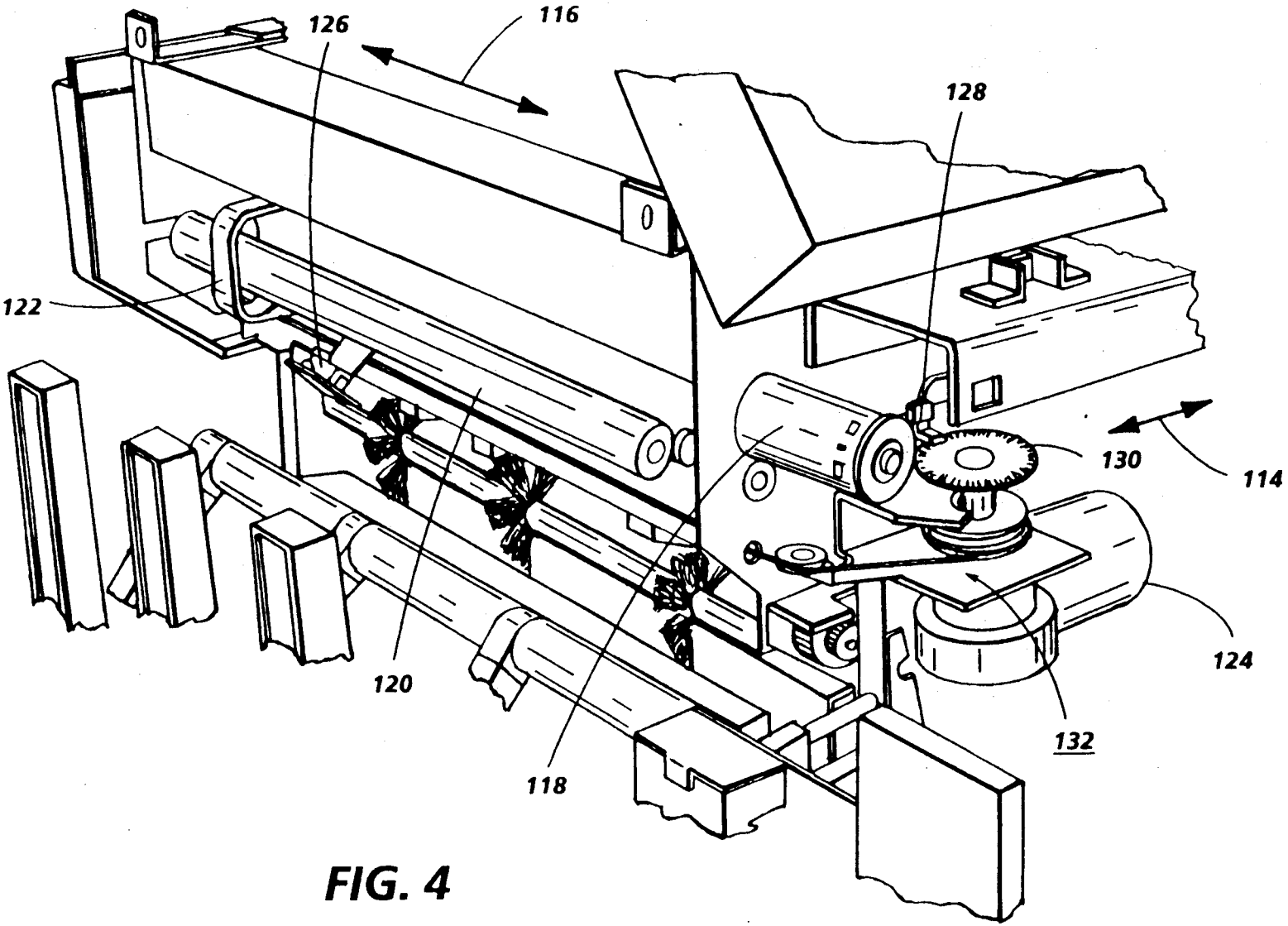
FIG. 4 is a perspective view depicting the apparatus for positioning the stapler in the FIG. 2 finishing station.
Figure 5:
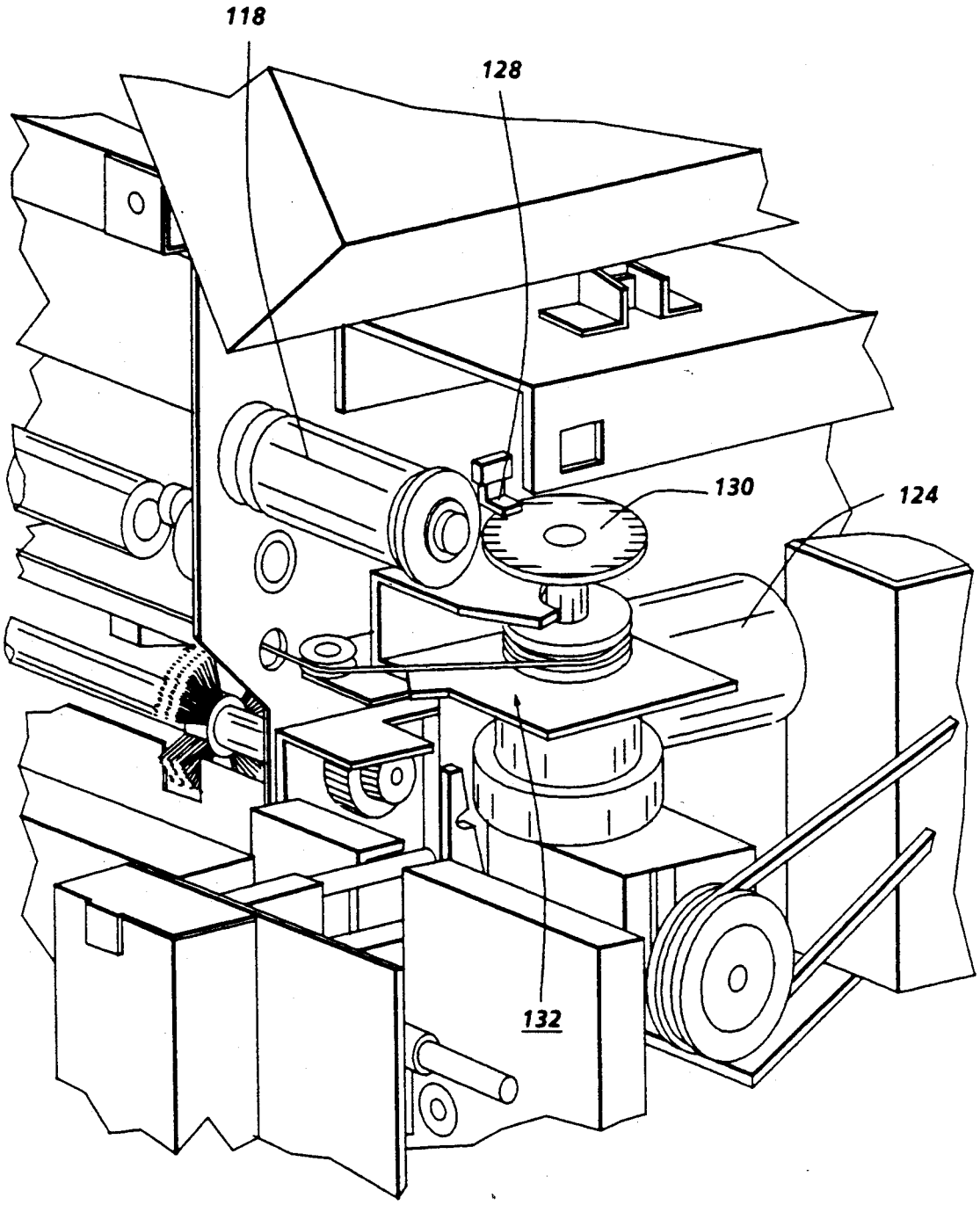
FIG. 5 is a fragmentary, perspective view depicting a portion of the FIG. 4 apparatus for positioning the stapler.

As shown in FIGS. 4 and 5, there are two motors that supply the stapler movement. Control logic signals motor 124 to move stapler 96 front to rear, i.e. in the direction of arrows 116, along long edge of the set of copy sheets in order to position the stapler at a predetermined location to staple the set of copy sheets. The movement is transmitted to stapler 96 through cable assembly 132. The control logic uses home sensor 126, position sensor 128 and encoder 130 to keep track of the location of stapler 96. Sensor 126 detects when stapler 96 is in the home position, as it moves along the edge of the set of sheets in the direction of arrows 116. Position sensor 128 and encoder 130 determine the position of stapler 96 relative to home sensor 126. The staple locations are selectable by adjusting the memory in the control logic and generally depend upon the size of the copy sheet. Motor 118 drives a cam 120 which moves yoke 122 in the direction of arrows 114. Yoke 122 transfers this movement from to cam 120 to stapler 96. In this way, cam 96 moves from left to right, i.e. from the operative position to the non-operative position, as indicated by arrows 114. Thus, stapler 96 moves to the left to staple the sheets of the copy set, and to the right in order to back away from the set of copy sheets. Generally, there are three staple options available, i.e. landscape, portrait and dual staple. In the landscape mode, the staple is placed in the lower left hand corner of the set of copy sheets. In the portrait mode, the stale is placed in the upper left hand corner of the set of copy sheets. In the dual staple mode, two staples are place in the left margin of the set of copy sheets. The staples are spaced from one another and in the upper left hand region and lower left hand region, respectively. In portrait stapling, the stapler is left at the home position and is moved from the non-operative position to the operative position after the compiler tray pivots to the stapling position. When compiling of the set of copy sheets is completed, the stapler is actuated placing a staple into the set of copy sheets. The stapler then moves to the non-operative position to enable the compiler tray to pivot down to the position for ejecting the set of copy sheets. For landscape stapling, the stapler moves, while in the non-operative position, along the long edge of the set of copy sheets to the predetermined staple position. This movement is from the front of the printing machine toward the rear of the printing machine. After the set of copy sheets is compiled on the compiler tray, the stapler advances from the non-operative position to the operative position and the stapler is actuated to place a staple in the set of copy sheets. The stapler then moves from the operative position to the non-operative position to enable the compiler tray to pivot to the eject position. In dual stapling, the stapler moves, while in the non-operative position, to the correct predetermined staple position in the rear of the printing machine. After the set of copy sheets is compiled on the compiler tray, the stapler moves from the non-operative position to the operative position and the stapler is actuated placing a staple into the set of copy sheets. While still in the operative position, the stapler moves toward the front of the printing machine to the correct predetermined second staple position and the stapler is actuated placing the second staple into the set of copy sheets. The stapler then moves from the operative position to the non-operative position to allow the compiler tray to pivot to the eject position and the stapler moves to the home position. The foregoing cycle is repeated for multiple sets of copy sheets.

Figure 6:
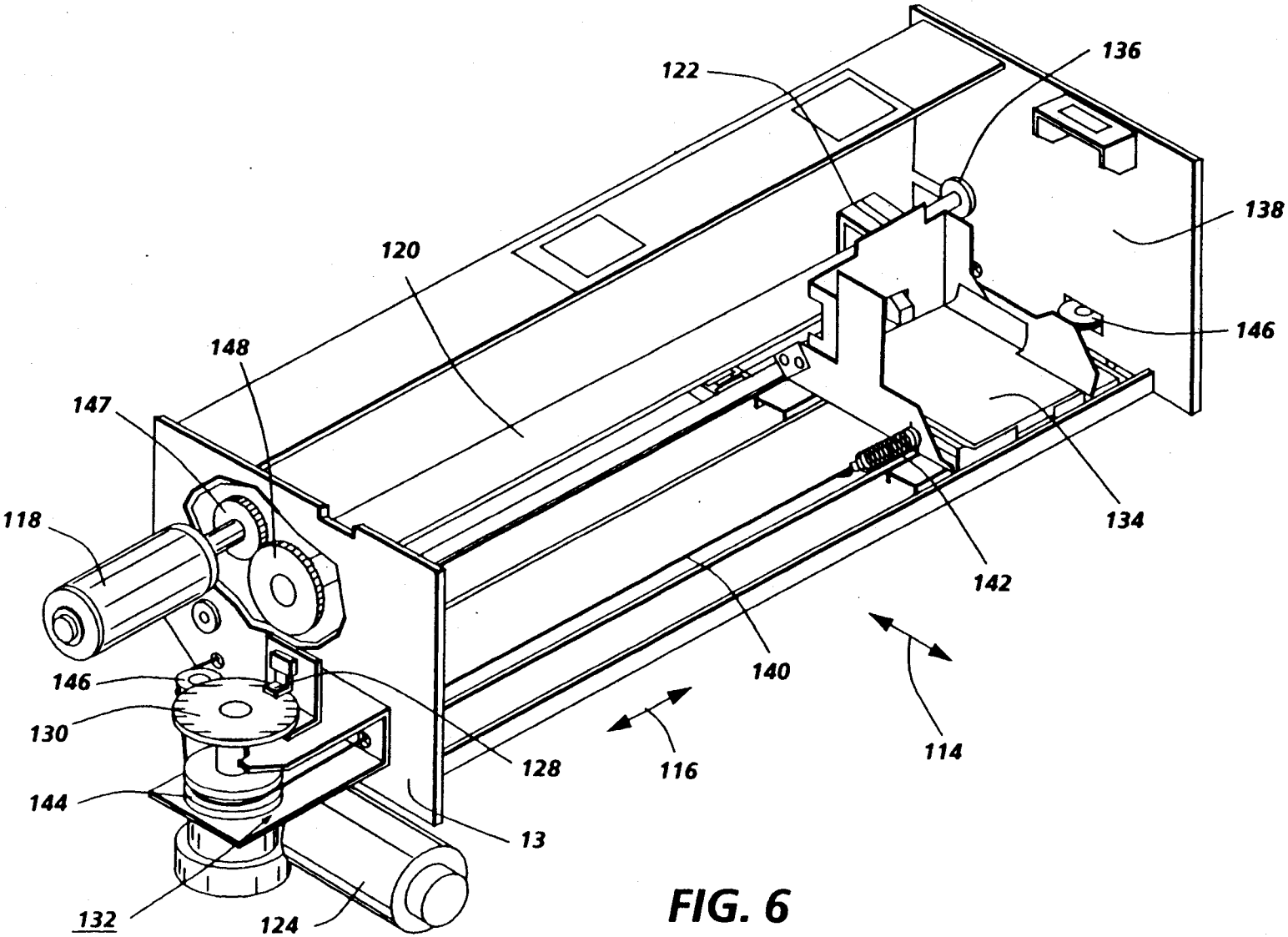
FIG. 6 is a perspective view of the stapler support and positioning apparatus.

Referring now to FIG. 6, there is shown further details of the apparatus for positioning stapler 96. As depicted thereat, stapler 96 (not shown) is supported on carriage 134. Carriage 134 is mounted on yoke 122. Yoke 122 is mounted slidably on cam 120. Cam 120 is mounted in hole 136 in frame 138 and a hole in the rear frame. Cable assembly 132 includes a cable 140 attached to one side of carriage 134 by spring 142. Cable 140 is wrapped around a capstan 144 and routed through a system of pulleys 146 to be attached to the other side of carriage 134. Indexing motor 124 is a reversible DC motor which drives capstan 144. In this way, energization of motor 124 drives capstan 144 which, in turn, moves cable 140 to slide carriage 134 and yoke 122 along cam 120. The direction of movement of carriage 134 is determined by the polarity of the DC voltage exciting motor 124. Sensor 124 (FIG. 4) is a channel sensor and is mounted to frame 138 and a flag is mounted on carriage 134 to indicate that the carriage is in the home position. The flag is also configured to tell the control logic to stop motor 124 when approaching the home position. Another channel sensor 128 is mounted near motor 124 and straddles encoder disk 130 mounted on capstan 144. This encoder/sensor system provides inputs to the control logic to allow for correct positioning of carriage 134. Movement between the non-operative position and the operative position is accomplished by eccentric cam 120 which spans the complete front to rear length of frame 138. Yoke 122 is mounted slidably on cam 120 and functions as a cam follower moving carriage 134 between the stapler operative and non-operative positions as indicated by arrows 114. Cam 120 is driven in 180° segments by gears 147 and 148. Gear 147 is mounted on the drive shaft of motor 118 and meshes with gear 148 mounted on cam 120. Motor is a non-reversing DC motor. A timing disc (not shown) is attached to the cam and is configured to interface a channel sensor (not shown) which provides signal inputs to the control logic to stop the cam in 180° increments. The timing disc also has a lag which interfaces with another channel sensor (not shown) to indicate that the cam and stapler is in the non-operative position.

Figure 7:
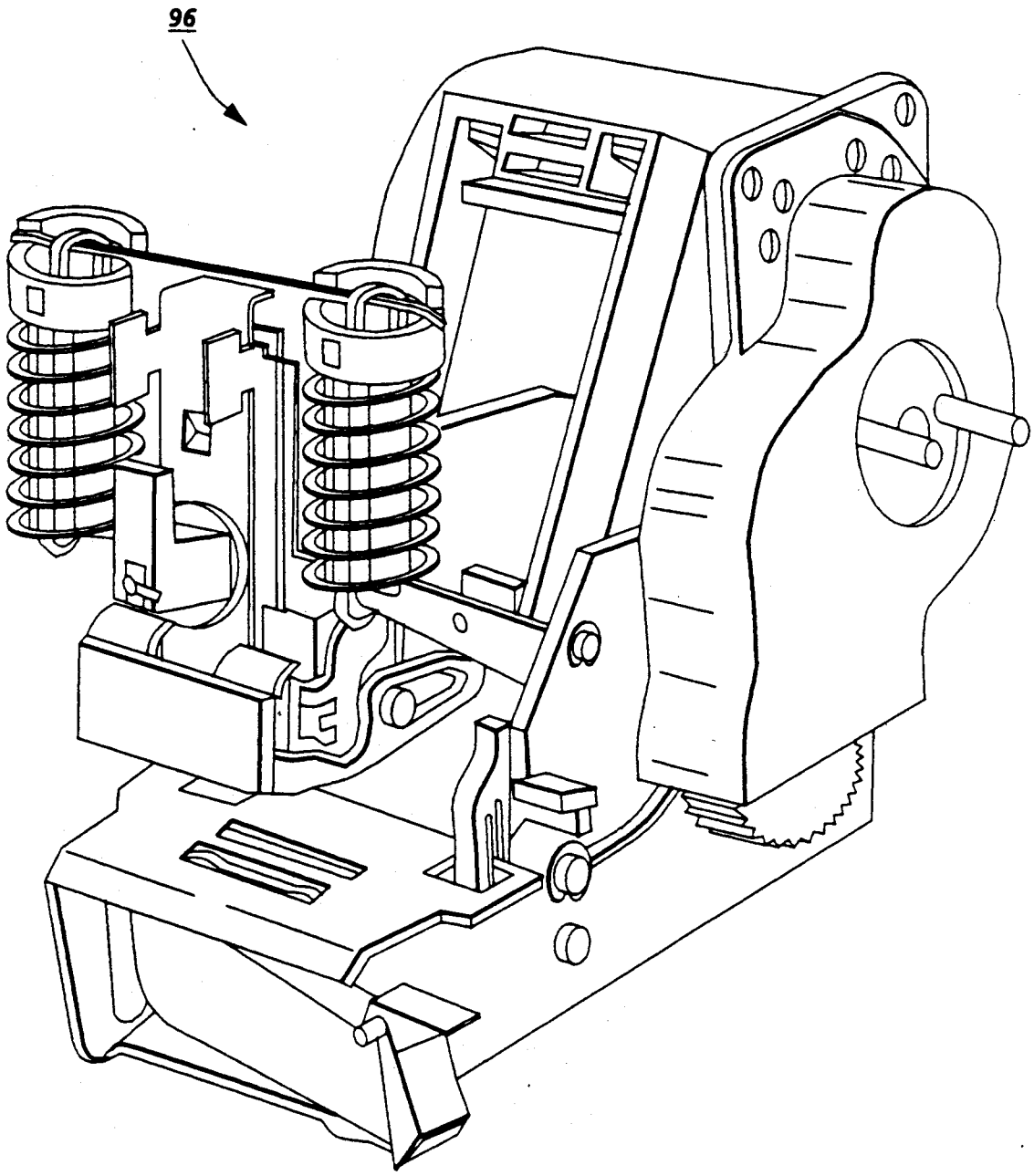
FIG. 7 is a perspective view of the stapler adapted to be mounted in the FIG. 6 stapler support.

FIG. 7 shows stapler 96 which is adapted to be mounted on carriage 134 (FIG. 6). A suitable stapler is manufactured by Max Company, Ltd. of Tokyo, Japan and is described in U.S. Pat. No. 4,623,082 issued Nov. 18, 1986 to Kurosawa, the relevant portions thereof being hereby incorporated into the present application.

In recapitulation, the apparatus of the present invention moves a stapler along the long edge of a set of copy sheets to predetermined positions for stapling thereat. In addition, the stapler is moved between the non-operative and operative positions. In the operative position, the stapler is adjacent the long edge of the set of copy sheets and, when in the predetermined position, staples the set of copy sheets. In the non-operative position, the stapler is located remotely from the lead edge of the set of copy sheets enabling the compiler tray supporting the set of sheets to pivot to an eject position. When the tray is in the eject position, the stapled set of copy sheets is ejected from the compiler tray to the stacker tray.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for positioning a stapling device relative to a set of sheets, including:

means for movably supporting the set of sheets;

means for moving the stapling device between an operative position adjacent to an edge of the set of sheets and a non-operative position spaced from the edge of the set of sheets said supporting means moving the set of sheets away from the stapling device in response to said moving means moving the stapling device from the operative position to the non-operative position; and means, responsive to said moving means moving the stapling device to the operative position, for transporting the stapling device in a direction substantially parallel to an edge of the set of sheets to a selected stapling position.

2. An apparatus for positioning a stapling device relative to a set of sheets, including:

a pivotable tray supporting the set of sheets;

means for moving the stapling device between an operative position adjacent to an edge of the set of sheets and a non-operative position spaced from the edge of the set of sheets; and means, responsive to said moving means moving the stapling device to the operative position, for transporting the stapling device in a direction substantially parallel to an edge of the set of sheets to a selected stapling position.

3. An apparatus according to claim 2, wherein said tray pivots away from the stapling device in response to said moving means moving the stapling device to the inoperative position.

4. An apparatus according to claim 3, further including means for sensing the location of the stapling device.

5. An apparatus according to claim 4, wherein said transporting means includes:

a carriage holding the stapling device;

means for supporting slidably said carriage;

a motor;

a plurality of pulleys; and a flexible cable attached to each side of said carriage and entrained about said plurality of pulleys, said motor being connected to said cable and being reversible to move said carriage bi-directionally.

6. An apparatus according to claim 5, wherein said moving means includes:

a frame having said supporting means mounted movably therein:

a motor; and means, coupled to said motor and said supporting means, for advancing and retracting said support means so that said stapling device moves between the operative position and the non-operative position.

7. An electrophotographic printing machine of the type in which copy sheets are advanced to a stapling device to produce stapled sets of copy sheets, wherein the improvement includes:

means for movably supporting the set of sheets;

means for moving the stapling device between an operative position adjacent to an edge of the set of copy sheets and a non-operative position spaced from the edge of the set of copy sheets said supporting means moving the set of sheets away from the stapling device in response to said moving means moving the stapling device from the operative position to the non-operative position; and means, responsive to said moving means moving the stapling device to the operative position, for transporting the stapling device in a direction substantially parallel to an edge of the set of copy sheets to a selected stapling position.

8. An electrophotographic printing machine of the type in which copy sheets are advanced to a stapling device to produce stapled sets of copy sheets, wherein the improvement includes:

a pivotable tray supporting the set of sheets;

means for moving the stapling device between an operative position adjacent to an edge of the set of copy sheets and a non-operative position spaced from the edge of the set of copy sheets; and means, responsive to said moving means moving the stapling device to the operative position, for transporting the stapling device in a direction substantially parallel to an edge of the set of copy sheets to a selected stapling position.

9. A printing machine according to claim 8, wherein said tray pivots away from the stapling device in response to said moving means moving the stapling device to the inoperative position.

10. A printing machine according to claim 9, further including means for sensing the location of the stapling device.

11. A printing machine according to claim 10, wherein said transporting means includes:

a carriage holding the stapling device;

means for supporting slidably said carriage;

a motor;

a plurality of pulleys; and a flexible cable attached to each side of said carriage and entrained about said plurality of pulleys, said motor being connected to said cable and being reversible to move said carriage bi-directionally.

12. A printing machine according to claim 11, wherein said moving means includes:

a frame having said supporting means mounted movably therein;

a motor; and means, coupled to said motor and said supporting means, for advancing and retracting said supporting means so that said stapling device moves between the operative position and the non-operative position.

* * * * *